US005968886A

United States Patent [19]

Kunz et al.

[11] Patent Number: 5,968,886

[45] Date of Patent: Oct. 19, 1999

[54] PERACETYLATED OR ACYLATED CARBOHYDRATES AS BLEACHING AGENT ACTIVATORS OR COMPLEXING AGENTS IN DETERGENT FORMULATIONS

[75] Inventors: Markwart Kunz, Worms; Jörg Kowalczyk, Grünstadt; Sonja Ehrhardt, Braunschweig, all of Germany

[73] Assignee: Sudzucker Aktiengesellschaft, Mannheim, Germany

[21] Appl. No.: 08/609,379

[22] Filed: Mar. 1, 1996

[30] Foreign Application Priority Data

Mar. 4, 1995 [DE] Germany ..... 195 07 668

[51] Int. Cl.[6] ..... C11D 3/22; C11D 3/39

[52] U.S. Cl. ..... 510/376; 510/312; 510/470; 510/471; 252/186.38

[58] Field of Search ..... 510/311, 312, 510/376, 470, 471; 252/186.38, 186.39

[56] References Cited

U.S. PATENT DOCUMENTS

| | | | |
|---|---|---|---|
| 3,723,322 | 3/1973 | Diehl | 510/471 |
| 3,784,475 | 1/1974 | Diehl | 510/471 |
| 3,873,614 | 3/1975 | Lamberti et al. | 510/471 |
| 3,919,107 | 11/1975 | Thompson | 510/471 |
| 3,956,278 | 5/1976 | Frey | 260/234 R |
| 4,016,090 | 4/1977 | Nakagawa et al. | 8/111 |
| 4,800,038 | 1/1989 | Broze et al. | 510/470 |
| 4,889,651 | 12/1989 | Broze | 510/470 |
| 5,312,907 | 5/1994 | Schattschneider et al. | 510/471 |
| 5,342,542 | 8/1994 | Burzio et al. | 252/186.39 |
| 5,344,581 | 9/1994 | Burzio et al. | 510/470 |
| 5,431,849 | 7/1995 | Damhus et al. | 252/186.38 |
| 5,437,810 | 8/1995 | Ewbank et al. | 510/471 |
| 5,447,648 | 9/1995 | Steindorf | 510/514 |
| 5,501,814 | 3/1996 | Engelskirchen et al. | 510/471 |

FOREIGN PATENT DOCUMENTS

| | | |
|---|---|---|
| 0 278 107 A1 | 8/1988 | European Pat. Off. . |
| 0 325 184 B1 | 7/1989 | European Pat. Off. . |
| 0325109 | 7/1989 | European Pat. Off. . |
| 0 380 437 A3 | 8/1990 | European Pat. Off. . |
| 0 517 969 A1 | 12/1992 | European Pat. Off. . |
| 0517969A | 12/1992 | European Pat. Off. . |
| 0527039A | 2/1993 | European Pat. Off. . |
| 0 540 279 A1 | 5/1993 | European Pat. Off. . |
| 43 07 388 A1 | 9/1994 | Germany . |
| 43 08 123 A1 | 9/1994 | Germany . |
| 4402051 A1 | 7/1995 | Germany . |
| 50-039707 | 4/1975 | Japan . |
| 50-091578 | 7/1975 | Japan . |
| 60-120800 | 6/1985 | Japan . |
| 5001090 | 1/1993 | Japan . |
| 5271696 | 10/1993 | Japan . |
| 9008182 | 7/1990 | WIPO . |
| WO 9110719A | 7/1991 | WIPO . |
| WO 94/28181 | 12/1994 | WIPO . |

OTHER PUBLICATIONS

F. Greenspan et al., "Analysis of Aliphatic Per Acids", Analytical Chemistry, 20(11):1061–1063 (1948).

H. Hauthal et al., "Studies Concerning the Mechanism of Bleaching Activation", Tenside Surf. Det. 27(3):187–193 (1990).

J. Mentech, "Sucrose Derivatives as Bleaching Boosters for the Detergent Industry", in G. Descotes, Carbohydrates as Organic Raw Materials, 1993, pp. 185–201.

V. Reinefeld et al., "Selektive Acylierung von Saccharose: Isolierung und Struktur von Fettsäure–Partialestern", Zucker, 21(12):330–338 (1968).

F. Richter et al., "Das Calciumbindevermögen", Tenside Surfactants Detergents, 24(4):213–216 (1987).

V.H. Haschke et al., "Poly–(hydroxycarboxylate) – Eine Klasse Vielseitiq Anwendbarer Komplexbildner", Chemiker–Zeitung 96(4):199–207 (1972).

R. Major et al., "The Acetyl Derivatives of Gluconic and Xylonic Acids", J. Am. Chem. Soc. 58:2474–2477 (1936).

"Activator for enzyme type bleacher and bleacher compsn.—giving high bleaching effect in short time, contg. specified poly:hydroxy:carboxylic acid deriv(s)", Derwent abstract 93–365523/46.

Naito et al., "Oxygen bleach activators and bleach compositions", Chemical Abstracts 120: 194544v (1994).

*Primary Examiner*—Paul Lieberman
*Assistant Examiner*—Lorna M. Douyon
*Attorney, Agent, or Firm*—Finnegan, Henderson, Farabow, Garrett & Dunner, L.L.P.

[57] ABSTRACT

The use of acylated carbohydrates selected from the group consisting of sucrose, maltose, lactose, palatinose, trehalulose, glucose and fructose or mixtures of these as a detergent constituent is characterized in that these acylated carbohydrate compounds contain one or two carboxyl functions and are in the form of the mono- or diacid or an alkali metal salt thereof, wherein the acyl radical is selected from the group consisting of C1- to C18-alkyl, tolyl and benzyl radicals and can be identical or different, and are used as bleaching agent activators or complexing agents in detergent formulations, the acyl radical preferably being a methyl radical.

15 Claims, 1 Drawing Sheet

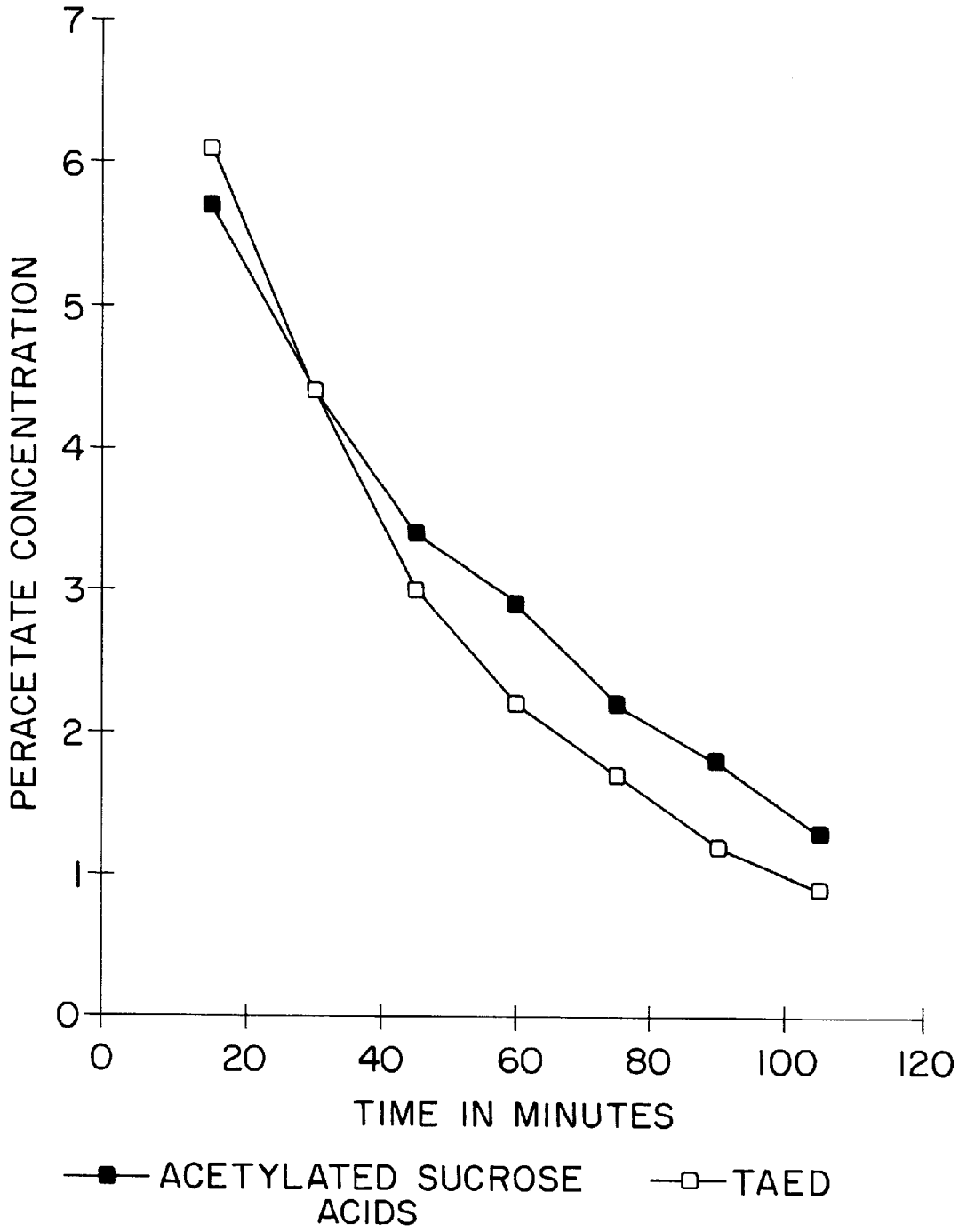
PERACETATE CONCENTRATION
0
1
2
3
4
5
6
7
0
20
40
60
80
100
120
TIME IN MINUTES
ACETYLATED SUCROSE ACIDS
TAED

PERACETYLATED OR ACYLATED CARBOHYDRATES AS BLEACHING AGENT ACTIVATORS OR COMPLEXING AGENTS IN DETERGENT FORMULATIONS

FIELD OF THE INVENTION

The invention relates to the use of peracetylated carbohydrates, and in particular those from the group consisting of sucrose, maltose, lactose, palatinose, trehalulose, glucose and fructose or mixtures thereof, as a bleaching agent activator or complexing agent in detergent formulations.

BACKGROUND OF THE INVENTION

Detergents also contain, in addition to surfactants and builders, per-compounds as bleaching agents, for example sodium perborate, or bleaching agent activators, such as tetraacetylethylenediamine (TAED). Since TAED has only two acetyl groups to form active species and the biological degradability of the remainder of the molecule is inadequate, and since furthermore the bleaching-active components are inactivated by the presence of metal cations, so that further complexing agents, such as acrylates and ethylenediaminotetraacetate (EDTA), have to be employed, all these detergents comprise components of difficult biological degradability.

Detergent components based on carbohydrates are gaining ever more importance in modern detergent research because they have a better biological degradability and are obtained from naturally regenerating raw materials.

For example, according to EP 0 325 184, acetylated sugar-ethers are employed for heavy-duty detergents because of their action as a bleaching activator and as a foam intensifier and because of their softening properties. EP 0 540 279 discloses 1-acyl-substituted acetylated sugars which, together with peroxides, cause the bleaching action in detergents and result in other properties which are suitable for detergents.

EP 0 380 437 discloses long-chain acylated mono- or diesters of hexoses which can likewise be employed as bleaching agent activators. The disadvantage of this compound is its poor water solubility, so that the activity thereof is significantly lower, in particular compared with TAED.

DE 43 08 123 A1 furthermore discloses acylated aminosaccharides as bleaching activators, but these are sometimes present as a yellowish oil and merely for this reason are not very suitable.

Finally, bleaching agent activators based on acetylated sucrose have been described by Mentech et al in "Carbohydrates as organic raw materials" (G. Descotes, 1993, pages 185–201). However, the preparation of partially acetylated sucrose leads to product mixtures, and it has been found that as bleaching agent activators the hexa- and hepta-acetyl-sucrose derivatives in particular correspond only to TAED in their activity. However, the preparation of these products is difficult, since the selectivity of the reaction can hardly be influenced in the direction of these derivatives.

SUMMARY OF THE INVENTION

The invention is based on the object of proposing quite specific carbohydrate compounds for use as bleaching activators or complexing agents in detergent formulations which no longer show the disadvantages of the products known to date.

To achieve this object, peracetylated carbohydrate compounds from the group consisting of sucrose, maltose, lactose, palatinose, trehalulose, glucose and fructose or mixtures of these, which contain one or two carboxyl functions and are in the form of the mono- or di-acid or the alkali metal salt thereof, are proposed for use as bleaching agent activators or complexing agents in detergent formulations.

Surprisingly, it has been found that these carbohydrate compounds not only are particularly suitable in respect of their preparation from industrial and economic aspects but that, in addition to their outstanding action as a bleaching agent activator, they also act as complexing agents and therefore render the addition of customary complexing agents superfluous or reduce the content thereof as a detergent component.

BRIEF DESCRIPTION OF THE DRAWING

FIG. 1 shows the formation of hydrogen peroxide for the bleaching agent system TAED/perborate in comparison with acetylated sucrose-monocarboxylic acids/perborate at 30° C.

DESCRIPTION OF THE PREFERRED EMBODIMENT

The peracetylated carbohydrate compounds having one or two carboxyl functions to be used according to the invention can be prepared by chemical oxidation, for example with NaOCl in accordance with EP 0 278 107, or by electrochemical oxidation or by catalytic oxidation with noble metal catalysts. The latter is described in DE-A 43 07 388. By appropriate choice of the catalyst, it is also possible to obtain the dicarboxylic acids.

The preparation of peracetylated monosaccharide acids is described in respect of gluconic acid by R. T. Major and E. W. Cook in J. Am. Chem. Soc., Volume 58, 2474–2477 (1936).

The acetylated dicarboxylic acid derivatives are prepared by a synthesis analogous to that of the mono-oxidized compounds.

The preparation of the acetylated monocarboxylic acid derivatives and dicarboxylic acid derivatives can be illustrated as follows purely by formulae by the example of sucrose:

For monooxidized products:

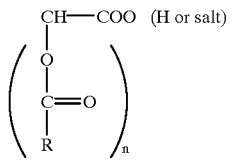

CH = carbohydrate unit

CH=monosaccharide→n=5

CH=disaccharide→n=7

R=$C_1$–$C_{18}$-alkyl, phenyl, tolyl, benzyl or else mixtures of these substituents For dioxidized products:

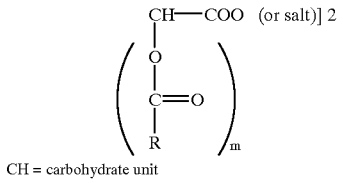

CH=monosaccharide→m=4
CH=disaccharide→m=6
R=$C_1$–$C_{18}$-alkyl, phenyl, tolyl, benzyl or also mixtures of these substituents The acetylation is known per se; reference is made to E. Reinefeld, Zucker, 21, 12 (1968).

In accordance with the acetylation, other derivatives with longer-chain alkyl chains or substituents are also suitable for acylation for the preparation of the detergent activators.

As regards the monooxidized products, the situation is as follows:

If sucrose is used as the carbohydrate, a mixture of 2-[α-D-glucopyranosyl]-β-D-fructofuranuronic acid (C-6 acid), 2-(α-D-glucopyranuronyl)-β-D-fructofuranoside (C-6' acid) and 2-keto-[2-(α-D-glucopyronosyl)-β-D-glucofuranonic acid (C-1 acid) with a purity of more than 95% is obtained by oxidation in each case of one of the primary OH groups potentially capable of reaction. For simplification, this product composition is called "sucrose acids" for short. These sucrose acids obtained are isolated as the sodium salt by drying.

It is possible to employ not only the monocarboxylic acids of sucrose as the starting substance but also other oxidized carbohydrates prepared by other processes, such as are listed in the following Table 1.

TABLE 1

Oxidized carbohydrates

| Carbohydrate | Oxidation product mixture for acetylation | | Abbreviation |
|---|---|---|---|
| Maltose | Maltobionic acid | Maltobiouronic acid | Mal |
| Lactose | Lactobionic acid | Lactobiouronic acid | Lac |
| Palatinose | 2-Keto-6-O-(α-D-glucopyranosyl)-D-arabino-hexonic acid | 6-O-(α-D-gluco-pyranuronyl)-D-fructofuranose | Pal |
| Trehalulose | 2-Keto-1-O-(α-D-glucopyranosyl)-D-arabino-hexonic acid | 1-O-(α-D-gluco-pyranuronyl)-D-fructofuranose | Tre |
| Glucose | Gluconic acid | Glucuronic acid | Gluc |
| Fructose | Fructuronic acid | 2-Keto-gluconic acid | Fruc |

The composition of the monooxidized product mixtures depends here on the catalyst used.

The peracetylation of the sucrose monooxidation products in some cases leads to new compounds which are outstandingly suitable as bleaching agent activators. The acetylation furthermore can be controlled such that all the OH functions on the molecule are esterified. For simplification, the products acetylated completely on the OH functions are designated with the abbreviation of the oxidation products and the annotation acetate (for example Suc-acetate).

The carboxyl function is obtained under the reaction conditions, so that compounds which, with 7 acetyl groups, are excellent bleaching agent activators and at the same time also display a water solubility adequate for the washing operation can be isolated.

The acetylation can be carried out in various ways. Acylating agents which can be employed are alkyl anhydrides and alkyl acid chlorides as well as various catalysts. Table 2 shows various methods for the preparation of peracetylated sucrose-monocarboxylic acids.

TABLE 2

Acetylation of oxidized sucrose

| Reagent | Solvent | Additional catalyst | Temperature | Time | Result |
|---|---|---|---|---|---|
| Acetyl chloride | Py | none | 0° C./room temp. | 90 min. | +/$^1$H-NMR |
| Acetic anhydride | none | ion exch. | 60° C. | 44 hrs | +/$^1$H-NMR |
| Acetic anhydride | none | Na acetate | 50° C. | 41 hrs | +/IR/ester |
| Acetic anhydride | none | Na acetate | 70° C. | 42 hrs | +/IR/ester |
| Acetic anhydride | Py | none | 0° C./room temp. | 24 hrs | +/ester |
| Acetic anhydride | Py | DMAP | 0° C./room temp. | 41 hrs | +/$^1$H-NMR |
| Acetic anhydride | $NEt_3$ | none | 0° C./room temp. | 20 hrs | +/$^1$H-NMR |
| Acetyl chloride | none | none | 0° C. | 90 min | +/$^1$H-NMR |
| Acetyl chloride | none | $ZnCl_2$ | 0° C./room temp. | 60 hrs | +/NMR |

The above table shows that the acetylations can be carried out with (a) acetyl chloride/pyridine,
(b) acetic anhydride/sodium acetate,
(c) acetic anhydride/zinc chloride.

The methods for preparation of the desired compounds are as follows:

(a) The esterification with acetyl chloride and pyridine is carried out at 0° C. In this case, the acetyl chloride is slowly added dropwise to the pyridine solution of the sucrose acids (molar ratio of pyridine:acetyl chloride:CHOH=10:2.5:1). After the reaction mixture has been stirred at 0° C. for 90 minutes, it is hydrolyzed slowly with water. The resulting solution is extracted several times with methylene chloride and the organic phase is dried and concentrated in vacuo. The substance isolated is purified with active charcoal (Norit SK) and used without further working-up for the use tests. The product is a white solid which is readily soluble in cold water.

(b) The reaction mixture of sodium acetate together with acetic anhydride and the sucrose acids are heated at 60° C. for 40 hours (molar ratio of NaAc:$Ac_2O$:CHOH=0.037:2.7:1); the reaction solution is allowed to cool and the solvent is removed in vacuo. The residue is dispersed in methylene chloride, the organic phase is purified with active charcoal and the solvent is distilled off.
The dried substance is a white solid and can be employed directly as a bleaching agent activator.

(c) In the case of esterification in acetic anhydride, dried zinc chloride is suspended in the reaction mixture, the mixture is cooled to 0° C. and the sucrose acids are added (molar ratio of $Ac_2O$:$ZnCl_2$:CHOH=2.3:0.13:1). The reaction mixture is warmed slowly to room temperature (1–2 hours) and stirred for 60 hours, and hydrolyzed with the addition of ice water. It is then extracted with methylene chloride and the organic phase is dried and concentrated. The product is obtained as a white solid and can like-wise be employed directly in detergent formulations.
IR and NMR spectra were used to demonstrate the structure of these acetylated products. The ester vibrations were clearly recognizable at 1770, 1240 and 1080 $cm^{-1}$. In the $^1$H-NMR, the $CH_3$ signals of the acetyl function appear in the form of several singlets lying close to one another around 2 ppm. The remaining C—H signals were obtained as several separate multiplets in the range of 5.8–3.95. The degree of acetylation can be determined via the proton ratio. In the case of complete acetylation, the theoretical ratio is 1:1.75. For the products obtained, the proton ratios determined were in the range of 1:1.49–1.74, so that virtually complete acetylation of the OH groups of the carbohydrate unit existed.

For comparison, lactobionic acid, maltobionic acid, oxidized isomaltulose and gluconic acid were acetylated by process (c) with acetic anhydride/zinc chloride. The peracetylated products based on the disaccharides are obtained as readily water-soluble solids, while the glucose product can be isolated only as an oil.

The procedure for evaluation of the bleaching activators to be used according to the invention was as follows:

The suitability of acetylated carbohydrate acids as an activator of sodium perborate was tested at 30° C. in 0.1 N sodium hydroxide solution (H. G. Hauthal, H. Schmidt, H. J. Scholz, J. Hofmann, W. Pritzkow, Tenside Surf. Det., 27, 187–193, 1990). The sodium perborate concentration was 0.23 M, that of the stabilizer ethyl-enediaminetetraacetic acid was $3\times10^{-3}$ M and that of the activator was 0.08 M.

TAED and peracetylated glucose (PAG) were used as comparison substances. Their formation of hydrogen peroxide and peracetic acid was recorded titrimetrically as a function of time, of the pH and of the bleaching agent (sodium perborate, sodium percarbonate). The hydrogen peroxide content was recorded cerimetrically in acid solution (5% strength sulfuric acid) at 0° C., and the formation of peracetate was determined indirectly via titration of the iodine liberated by the per-acid with sodium thiosulfate solution (F. P. Greenspan, D. G. Mackellar, Anal. Chem., 20, 1061–1062, 1948).

The following Table 3 shows the properties of the activators under the above standard conditions after 30 minutes. The percentage data are molar percentages; they are based on the amount of acetate present in the activators employed.

TABLE 3

Peroxide formation after 30 minutes at T = 30° C. (perborate; 0.1N NaOH)

| Substance | $H_2O_2$ (mol %) | Peracetate (mol %) |
|---|---|---|
| TAED | 21 | 30 |
| PAG | 19 | 27 |
| Suc-acetate | 13 | 31 |
| Mal-acetate | 15 | 29 |
| Lactobion-acetate | 18 | 18 |
| Gluc-acetate | 43 | 12 |

The products based on carbohydrates show properties which are as good as and sometimes better than those of TAED in respect of formation of hydrogen peroxide and peracetate.

The following Table 4 shows the properties in the presence of sodium percarbonate.

TABLE 4

Peroxide formation in the presence of sodium percarbonate (T = 30° C.; 0.1N NaOH)

| Substance | $H_2O_2$ (mol %) | Peracetate (mol %) |
|---|---|---|
| TAED | 38 | 43 |
| Suc-acetate | 6 | 40 |
| Lactobion-acetate | 9 | 44 |
| Gluc-acetate | 32 | 42 |
| Mal-acetate | 9 | 44 |

Although the formation of hydrogen peroxide with the carbohydrate products is not so pronounced in these examples, the formation of peracetate is again of the order of magnitude found with TAED.

If the dependence of the formation of hydrogen peroxide and peracetate by the systems TAED, Suc-acetate, lactobion-acetate in 0.1 N sodium hydroxide solution and in a borax/sodium hydroxide solution buffer solution (pH=9.9) on time is considered, it can be seen that, although the initial amount of the two peroxide components is somewhat higher in the case of TAED, the total amount of these bleaching-active species formed is significantly higher in the case of the carbohydrate-based products.

FIG. 1 shows the formation of hydrogen peroxide for the bleaching agent system TAED/perborate in comparison with acetylated sucrose-monocarboxylic acids/perborate at 30° C. In this figure, apart from at the initial concentration, the hydrogen peroxide concentration in the case of the carbohydrate-based bleaching activator is above the TAED curve. This was likewise observed when sodium percarbonate was used as the bleaching agent. The curve of the carbohydrate bleaching activator is likewise above that of TAED in respect of the formation of peracetate.

Generally, it can be said for the acetylated carbohydrate acids that these substances are excellently suitable as bleaching agent activators in detergent formulations. These systems show a very good bleaching action at low temperatures in particular (30 to 40° C.). Equivalent results compared with TAED were to be achieved in the washing test with standard fabrics and standard soiling (red wine, grass and tea stains).

Acetylated sucrose acids and other carbohydrate-based peracetylated products show an excellent bleaching action with the customary bleaching agents such as sodium perborate and sodium percarbonate. Compared with TAED, the activity is initially lower, but the formation of hydrogen peroxide and peracetate is higher than in the case of TAED.

In buffered solution, the formation of the peracetates slows down, and the hydrogen peroxide concentration is correspondingly higher. The period within which washing-active species are present is prolonged. In the case of the carbohydrate-based bleaching agent systems, the influence due to a buffer solution is similar to that in the case of TAED.

In the presence of percarbonate, the rate of formation of the peroxo species is even higher than in the case of perborate, which is to be attributed to the different structural circumstances.

An essential side effect of the activator properties of acetylated sucrose acids is their complexing property and therefore their suitability as sequestering agents. This was tested with the aid of the Hampshire test. At 88 mg of $CaCO_3$ per g of originally acetylated sucrose acid, the value is lower than for compounds employed to date, at 200 ppm per g of substance (F. Richter, E. W. Winkler, Tenside Surf. Det., 24, 213–216, 1987).

After use as an activator, the calcium bonding power of the reaction solution was tested titrimetrically. In parallel to this, the calcium bonding power of the free carbohydrate acids was determined. The free acids (in each case 1 g) were neutralized with 0.1 N NaOH, and 10 ml of 2% strength sodium carbonate solution were then added. The solution was topped up to 100 ml (pH brought to 11) and titrated with 0.25 M Ca acetate solution. In both cases, it was found that the carbohydrate-based bleaching agent components show corresponding complexing properties with respect to calcium.

In order to test the bleaching action in a detergent-like formulation, after the acetylated sugar acids had been heated in the presence of sodium percarbonate at 30° C. in 0.1 N NaOH for 30 minutes, the Ca bonding power was tested by titration with 0.25 M calcium acetate solution until clouding occurred.

It was found that an addition of another complexing agent (in this case EDTA) led to no significant reduction in the Ca ions. By using the carbohydrate-based bleaching agent activators, it was sufficient to establish the Ca ion concentration at significantly below 200 ppm.

As a further side effect, it was found in the washing tests that the compounds according to the invention employed act as softening agents for laundry, especially in the form of longer-chain fatty acid derivatives.

As a result of these surprising additional properties, ecologically unacceptable compounds employed to date could be replaced or employed in significantly reduced amounts when the products used according to the invention are used in detergent formulations. The products according to the invention are readily biologically degradable and are thus to be classified ecologically as acceptable.

The invention is illustrated below with the aid of examples:

EXAMPLE 1

Preparation of Acetylated Sucrose Acids by Esterification with Acetyl Chloride and Pyridine The acetyl chloride is slowly added dropwise to the pyridine solution of the sucrose acids at 0° C. (molar ratio of pyridine:acetyl chloride:CHOH=10:2.5:1). After the reaction mixture has been stirred at 0° C. for 90 minutes, it is hydrolyzed slowly with water. The resulting solution is extracted several times with methylene chloride and the organic phases are dried and concentrated in vacuo. The yellowish-colored substance isolated is purified with active charcoal and used without further working-up for the use tests. The yield is approximately quantitative. A typical standard batch for preparation of the acetylated sucrose acids is described:

4 g of sucrose acids as the sodium salt (11 mmol)
dissolved in 59.3 ml of pyridine (0.73 mol) or present as a fine suspension, 13.1 ml of $CH_3COCl$ (0.18 mol)
add about 100 ml of water dropwise, initially slowly, for the hydrolysis
extract 3–4 times with about 30–40 ml of methylene chloride, dry over sodium sulfate The resulting product was obtained as a white solid and could be employed directly for the use tests.

EXAMPLE 2

Preparation of Acetylated Lactobionic Acids by Esterification with Sodium Acetate and Acetic Anhydride The reaction mixture of sodium acetate, acetic anhydride and lactobionic acid is heated at 60° C. for 40 hours (molar ratio of NaAc:$Ac_2O$:CHOH=0.037:2.7:1); the brown-colored reaction solution is allowed to cool and the solvent is removed in vacuo. The residue is dispersed in methylene chloride, the organic phase is decolorized with active charcoal and the solvent is distilled off. The dried substance is used for the subsequent investigations. The following test batch was carried out:

take up 1 g of lactobionic acid (2.6 mmol) in
4.69 ml of acetic anhydride (50 mmol) and add
0.056 g of sodium acetate (anhydrous; 0.7 mmol)

The resulting product was yellowish and was obtained as a white solid after renewed recrystallization.

EXAMPLE 3

Preparation of Acetylated Sucrose Acids by Esterification with Zinc Chloride and Acetic Anhydride Dried zinc chloride is suspended in acetic anhydride, the mixture is cooled to 0° C. and the sucrose acids are added (molar ratio of $Ac_2O$:$ZnCl_2$:COOH=2.3:0.13:1). The reaction mixture is warmed slowly to room temperature (1–2 hours) and stirred for 60 hours; it is then hydrolyzed by addition of ice water. It is subsequently extracted several times with methylene chloride and the organic phase is concentrated and dried. The product is obtained as a colorless substance.

1 g of sucrose acids are added
to a suspension of 4.9 ml of acetic anhydride (52 mmol) and 0.18 g of anhydrous zinc chloride (1.3 mmol);
the mixture is hydrolyzed with about 20 ml of ice water and extracted 3–4 times with about 20 ml of methylene chloride (see above).

The resulting product is obtained as a white solid which can be employed directly in detergent formulations.

IR and NMR spectra were used to demonstrate the structure. The ester vibrations were clearly recognizable at 1770, 1240 and 1080 $cm^{-1}$. In the $^1$H-NMR, the $CH_3$ signals of the acetyl function appear in the form of several singlets lying close together around 2 ppm. The remaining C—H signals were obtained as several separate multiplets in the range of 5.8–3.95.

The best result in respect of the color of the product was achieved according to Example 3 with acetic anhydride/zinc chloride, and in the case of the other two processes, the product was additionally purified by active charcoal. In all three cases, the substance is isolated as a readily water-soluble solid.

For comparison, gluconic acid was acetylated with acetic anhydride/zinc chloride analogously to Example 3, but the product was to be isolated only as an oil.

EXAMPLE 4

Action of the Compounds to be used According to the Invention as a Bleaching Agent Activator in Combination with Sodium Percarbonate 0.023 g of ethylenediaminetetraacetic acid (EDTA) is dissolved in 28.7 ml of a 0.1 N sodium hydroxide solution, and the corresponding amount of activator (0.08 molar solution) and $6.6\times10^{-3}$ mol of sodium percarbonate (1.036 g) are added at 30° C. Samples of 3 ml are taken every 15 minutes, added dropwise to 3.5 ml of 5% strength sulfuric acid, while cooling with ice, and titrated rapidly with 0.1 N cerium ammonium sulfate solution (1 N $H_2SO_4$) (indicator ferroin). 1 ml of 10% strength potassium iodide solution is then added to the solution. The iodide formed is determined titrimetrically with 0.1 N sodium thiosulfate solution.

The following substances were tested as bleaching agent activators:

a) tetraacetylethylenediamine (TAED)
b) sucrose acid, acetylated (Suc ester)
c) lactobionic acid, acetylated (Lac ester)
d) gluconic acid, acetylated (Gluc ester)
e) maltobionic acid, acetylated (Mal ester)

Instead of 0.1 N sodium hydroxide solution, a borax/NaOH buffer solution (at 20° C., pH 10) was employed in another series of tests.

The tests were likewise carried out at 40° C. The results are summarized in Table 5.

EXAMPLE 4b

Action of the Compound used according to the Invention as a Bleaching Agent Activator in Combination with Sodium Perborate Sodium percarbonate is replaced by sodium perborate (1.041 g=$6.6\times10^{-3}$ mol). The other reaction parameters remain unchanged.

Instead of 0.1 N sodium hydroxide solution, a borax/NaOH buffer solution (at 20° C., pH 10) is employed in another series of tests.

Further tests were carried out at 40° C. The results are shown in Table 5.

TABLE 5

Peracetate formation (in mol %) as a function of different bleaching agents and temperatures in 0.1N NaOH or buffer for 15–105 minutes (30° C.) or 10–80 minutes (40° C.)

| | | NaOH temperatures | | Buffer temperatures | |
|---|---|---|---|---|---|
| Substance | Bleaching agent | 30° C. | 40° C. | 30° C. | 40° C. |
| TAED | Na perborate | 32 | 19 | 42 | 24 |
| TAED | Na percarbonate | 31 | 15 | 50 | 32 |
| Suc-acetate | Na perborate | 18 | 13 | 24 | 21 |
| Suc-acetate | Na percarbonate | 20 | 15 | 26 | 21 |
| Lac-acetate | Na perborate | 18 | 19 | 22 | 18 |
| Lac-acetate | Na percarbonate | 23 | 18 | 28 | 29 |
| Glu-acetate | Na perborate | 36 | 31 | 43 | 47 |
| Glu-acetate | Na percarbonate | 55 | 43 | 52 | 50 |
| Mal-acetate | Na perborate | 17 | 21 | 26 | 12 |
| Mal-acetate | Na percarbonate | 18 | 21 | 12 | 29 |

EXAMPLE 5

Action of the Compounds to be used according to the Invention as Complexing Agents in the Hampshire Test with Sodium Perborate The calcium binding power of the reaction solution was tested titrimetrically by the Hampshire method. For this, 10 ml of a 2% strength sodium carbonate solution were added to the reaction solution and the mixture was topped up to 100 ml. It was then titrated with 0.25 M calcium acetate solution until clouding occurred.

The minimum amounts of activator (acetylated carbohydrate 1 g) were, in the case of [lacuna]

1 g Suc-acetate (650.543 g/mol, $1.54\times10^{-3}$ mol)
in 19.2 ml of 0.1 N NaOH with 0.015 g of EDTA (ethylenediaminetetraacetic acid, 292.24 g/mol) and
with 0.679 g of sodium perborate (153.86 g/mol; $4.41\times10^{-3}$ mol) at 30° C. for 30 minutes;
10 ml of 2% strength $Na_2CO_3$ were added and the volume enlarged to 100 ml with distilled water. The pH should be 11, adjust with a few drops of 1 N NaOH or with 1 N HCl according to circumstances.

For this, 10 ml of a 2% sodium carbonate solution were added to the reaction solution and the mixture was topped up to 100 ml. It was then titrated with 0.25 M calcium acetate solution until clouding occurred (H. Haschke, G. Morlock, P. Kuzel, Chem. Ztg., 96, 199–207, 1990). At 88 mg of $CaCO_3$ per g of originally acetylated sucrose acid, the value is lower than that of compounds employed to date, at 200 mg per g of substance (F. Richter, E. W. Winkler, Tenside Surf. Det., 24, 213–216, 1987). A value of 57 mg was obtained with the TAED solution (see Table 6).

TABLE 6

Hampshire test on the acetylated carbohydrate acids in the presence of sodium perborate

| Substance | Amount of Ca carbonate (mg) |
|---|---|
| TAED | 57 |
| Suc-acetate | 88 |
| Lac-acetate | 38 |
| Mal-acetate | 36 |
| Glu-acetate | 42 |

EXAMPLE 6

Investigation of the Action as a Complexing Agent in the Hampshire Test with Sodium Percarbonate The calcium binding power was determined in the presence of sodium percarbonate, the values shown in the following Table 7 being determined.

TABLE 7

Hampshire test in the peracetylated carbohydrate acids in the presence of sodium percarbonate

| Substance | Amount of Ca carbonate (mg) |
|---|---|
| Suc-acetate | 33 |
| Lac-acetate | 31 |
| Glu-acetate | 28 |
| Mal-acetate | 30 |

EXAMPLE 7

Action of the Compounds according to the Invention as Completing Agents in the Washing Test with Sodium Percarbonate To test the bleaching action in a detergent-like formulation, after the acetylated sugar acids had been heated in the presence of sodium percarbonate at 30° C. in 0.1 N NaOH for 30 minutes, the Ca bonding power was tested by titration with 0.25 M calcium acetate solution until clouding occurred. For this, with in each case 1 g of the substance to be investigated, a 0.08 M solution which furthermore has a content of EDTA (ethylenediamine-tetraacetic acid) of $2.7\times10^{-3}$ molar and of sodium percarbonate of 0.23 molar was prepared with 0.1 N sodium hydroxide solution as the solvent. After activator activity at 30° C. for 30 minutes, 10 ml of aqueous 2% strength sodium carbonate solution are added to the solution, which has been cooled to room temperature, the pH is brought to 11 with 1 N sodium hydroxide solution and the volume is increased to 100 ml with distilled water. The solution is titrated with 0.25 M calcium acetate solution until clouding remains.

The results are summarized in the following table.

TABLE 8

| Hampshire test with sodium percarbonate as the bleaching agent | |
|---|---|
| Substance | Amount of Ca carbonate (mg) |
| TAED | 7.5 |
| Suc-acetate | 10.5 |
| Lactobion-acetate | 10 |
| Maltobion-acetate | 11 |
| Glu-acetate | |

EXAMPLE 8

Action of the Compounds to be used according to the Invention as Complexing Agents in the Washing Test with Sodium Metacarbonate [Sic]

In each case 1 g of the sugar acid (in the form of the sodium salt; lactobionic acid neutralized with 30 ml of 0.1 N sodium hydroxide solution) is taken up in distilled water, 10 ml of 2% strength sodium carbonate solution are added and the mixture is topped up to 100 ml. In addition, sodium metaborate (molar ratio of borate/carbohydrate 3:1) was additionally admixed to the solution and the pH was brought to 11 with 1 N sodium hydroxide solution. The mixture was titrated with 0.25 M calcium acetate solution until clouding remained.

The results can be seen from the following table:

TABLE 9

| Hampshire test in the presence of sodium metaborate | |
|---|---|
| Substance | Amount of calcium carbonate (mg) |
| Suc-COOH | 47 |
| Lac-COOH | 125 |
| Mal-COOH | 107 |
| Glu-COOH | 325 |

We claim:

1. An acylated mono- or dioxidized carbohydrate bleaching agent activator or complexing agent in a detergent formulation, wherein the carbohydrate is selected from the group consisting of sucrose, maltose, lactose, palatinose, trehalulose, fructose and mixtures thereof, contains one or two carboxyl functions and is in the form of the mono- or dicarboxylic acid or an alkali metal salt thereof, and wherein the acyl radical is selected from the group consisting of $C_1$- to $C_{18}$-alkyl, tolyl and benzyl radicals and can be identical or different.

2. An acylated carbohydrate according to claim 1, wherein the acylated carbohydrate is an acylated disaccharide-carboxylic acid selected from the group consisting of sucrose, maltose, lactose, palatinose, trehalulose and mixtures thereof.

3. An acylated carbohydrate according to claim 1 or 2, wherein the acylated carbohydrate is a peracetylated disaccharide-carboxylic acid.

4. An acylated carbohydrate according to claim 3, wherein the acylated carbohydrate is a peracetylated sucrose-carboxylic acid.

5. An acylated carbohydrate according to claim 1 or 2, wherein the acylated carbohydrate is a peracetylated sucrose-carboxylic acid.

6. An acylated carbohydrate according to claim 5, wherein the acyl radical is a methyl radical.

7. An acylated carbohydrate according to claim 4, wherein the acyl radical is a methyl radical.

8. An acylated carbohydrate according to claim 3, wherein the acyl radical is a methyl radical.

9. An acylated carbohydrate according to claim 1 or 2, wherein the acyl radical is a methyl radical.

10. An acylated mono- or dioxidized carbohydrate bleaching agent activator or complexing agent in a detergent formulation also containing a per-compound bleaching agent, wherein the carbohydrate is selected from the group consisting of sucrose, maltose, lactose, palatinose, trehalulose, fructose and mixtures thereof, contains one or two carboxyl functions and is in the form of the mono- or dicarboxylic acid or an alkali metal salt thereof, and wherein the acyl radical is selected from the group consisting of $C_1$- to $C_{18}$-alkyl, tolyl and benzyl radicals and can be identical or different.

11. A detergent formulation comprising a per-compound bleaching agent and an acylated mono- or dioxidized carbohydrate bleaching agent activator or complexing agent, wherein the carbohydrate is selected from the group consisting of sucrose, maltose, lactose, palatinose, trehalulose, fructose and mixtures thereof, contains one or two carboxyl functions and is in the form of the mono- or dicarboxylic acid or an alkali metal salt thereof, and wherein the acyl radical is selected from the group consisting of $C_1$- to $C_{18}$-alkyl, tolyl and benzyl radicals and can be identical or different.

12. A method for activating a bleaching agent which comprises contacting the bleaching agent with an acylated carbohydrate, wherein the acylated carbohydrate is an acylated disaccharide-carboxylic acid selected from the group consisting of sucrose, maltose, lactose, palatinose, trehalulose and a mixture thereof, or an alkali metal salt thereof, and wherein the acyl radical is selected from the group consisting of $C_1$- to $C_{18}$-alkyl, tolyl and benzyl radicals and can be identical or different.

13. A method according to claim 12, wherein the acylated carbohydrate is a peracetylated disaccharide-carboxylic acid.

14. A method according to claim 13, wherein the acylated carbohydrate is a peracetylated sucrose-carboxylic acid.

15. A method according to claim 12, wherein the bleaching agent is present in a detergent composition.

* * * * *